US007040130B2

(12) United States Patent
Liu et al.

(10) Patent No.: US 7,040,130 B2
(45) Date of Patent: May 9, 2006

(54) METHOD AND APPARATUS FOR FORMING DISCRETE MICROCAVITIES IN A FILAMENT WIRE USING MICROPARTICLES

(75) Inventors: Xinbing Liu, Acton, MA (US); Ming Li, Chelmsford, MA (US); Makoto Ishizuka, Osaka (JP); Daniel Hogan, Acton, MA (US); Kazuaki Ohkubo, Takatsuki (JP); Mitsuhiko Kimoto, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 233 days.

(21) Appl. No.: 10/685,262

(22) Filed: Oct. 14, 2003

(65) Prior Publication Data

US 2005/0076689 A1 Apr. 14, 2005

(51) Int. Cl.
*B21J 1/00* (2006.01)
*B24C 11/00* (2006.01)

(52) U.S. Cl. ..... 72/53; 451/38

(58) Field of Classification Search ..... 72/53; 451/38, 39, 40, 28, 36; 29/90.7
See application file for complete search history.

(56) References Cited

U.S. PATENT DOCUMENTS 3,423,976 A * 1/1969 Burney et al. ..... 72/53
4,291,444 A 9/1981 McCarty et al.
4,440,729 A * 4/1984 Jonsson ..... 216/93
5,277,048 A * 1/1994 Lubas ..... 72/53
5,389,853 A 2/1995 Bigio et al.
5,592,840 A * 1/1997 Miyasaka ..... 72/53
5,904,610 A * 5/1999 Ciniglio et al. ..... 451/38
5,955,839 A 9/1999 Jaffe et al.
6,433,303 B1 8/2002 Liu et al.
2003/0032369 A1* 2/2003 Carpenter

OTHER PUBLICATIONS

Waymouth, John F., "Where Will the Next Generation of Lamps Come From?", Sep. 10-14, 1989; Presented at the Fifth International Symposium on the Science and Technology of All Light Sources; York, England.*
H. Craighead et al., Selectively Emissive Refractory Metal Surfaces, 38 Applied Physics Letters 74, 1981.
J. Waymouth, Where Will the Next Generation of Lamps Come From?, Fifth International Symposium on the Science and Technology of all Light Sources, Sep. 10-14, 1989, pp. 22-25 and Fig. 20, York, England.

* cited by examiner

*Primary Examiner*—Derris H. Banks
*Assistant Examiner*—Debra M Wolfe
(74) *Attorney, Agent, or Firm*—RatnerPrestia

(57) ABSTRACT

A microcavity forming device is provided for making microcavities in a tungsten wire. The microcavity forming device includes a source of particles; a housing for receiving a heated tungsten wire; and a plurality of jet nozzles disposed in the housing for spraying the particles toward the heated tungsten wire. The particles are 0.35–0.75 micron in diameter. The heated tungsten wire is received in the housing and the jet nozzles spray the particles toward the tungsten wire to form the microcavities in the tungsten wire.

20 Claims, 6 Drawing Sheets

METHOD AND APPARATUS FOR FORMING DISCRETE MICROCAVITIES IN A FILAMENT WIRE USING MICROPARTICLES

FIELD OF THE INVENTION

This invention relates to forming microcavities in filament wires to improve their radiative efficiency. More particularly, this invention relates to a device and method for forming microcavities in a filament wire suitable for mass manufacturing environments.

BACKGROUND OF THE INVENTION

The cost of producing and purchasing electricity has escalated to all-time highs worldwide. This is especially true in under-developed countries where electricity supply is limited, as well as in those countries with large populations where the demand for electricity is high. Driven by this demand is an ever-increasing desire to produce lighting sources that are energy efficient and minimize the cost of electric usage.

Over the past two centuries, scientists and inventors have strived to develop a cost-effective, practical, long-life incandescent light bulb. Developing a long-life, high-temperature filament is a key element in designing a practical incandescent light bulb.

Tungsten filaments have been found to offer many favorable properties for lighting applications, such as a high melting point (3,410° C./6,170° F.), a low evaporation rate at high temperatures (10−4 torr at 2,757° C./4,995° F.), and a tensile strength greater than steel. These properties allow the filament to be heated to higher temperatures to provide brighter light with favorable longevity, making tungsten a preferred material for filaments in commercially available incandescent light bulbs.

The filament of an incandescent lamp emits visible and non-visible radiation when an electric current of sufficient magnitude is passed through it. The filament emits, however, a relatively small portion of its energy, typically 6 to 10 percent, in the form of visible light. Most of the remainder of the emitted energy is in the infrared region of the light spectrum and is lost in the form of heat. As a consequence, radiative efficiency of a typical tungsten filament, measured by the ratio of power emitted at visible wavelengths to the total radiated power over all wavelengths, is relatively low, on the order of 6 percent or less.

Conventional techniques for increasing the amount of visible light emitted by an incandescent filament rely on increasing the amount of energy available from the filament by increasing the applied electrical current. Increasing the current, however, wastes even larger amounts of energy. What is needed is a tungsten filament that emits increased visible light, without increasing energy consumption.

Another concern is the life span of a filament. A tungsten filament is very durable, but after a prolonged period of time large electrical currents cause excessive electron wind, which occurs when electrons bombard and move atoms within the filament. Over time, this effect causes the filament to wear thin and eventually break.

It has been observed that the radiative efficiency of filament material such as tungsten may be increased by texturing the filament surface with submicron sized features. A method of forming submicron features on the surface of a tungsten sample using a non-selective reactive ion etching technique is disclosed by H. G. Craighead, R. E. Howard, and D. M. Tennant in "Selectively Emissive Refractory Metal Surfaces," 38 Applied Physics Letters 74 (1981). Craighead et al. disclose that improved radiative efficiency results from an increase in the emissivity of visible light from the tungsten. Emissivity is the ratio of radiant flux, at a given wavelength, from the surface of a substance (such as tungsten) to radiant flux emitted under the same conditions by a black body. The black body assumes to absorb radiation incident upon it.

Craighead et al. disclose that the emissivity of visible light from a textured tungsten surface is twice that of a non-textured surface, and suggest that the increase is a result of more effective coupling of electromagnetic radiation from the textured tungsten surface into free space. The textured surface of the tungsten sample disclosed by Craighead et al. has depressions in the surface separated by columnar structures projecting above the filament surface by approximately 0.3 microns.

Another method for enhancing incandescent lamp efficiency by modifying the surface of a tungsten lamp filament appears in a paper entitled "Where Will the Next Generation of Lamps Come From?", by John F. Waymouth, pages 22–25 and FIG. 20, presented at the Fifth International Symposium on the Science and Technology of all Light Sources, York, England, on Sep. 10–14, 1989. Waymouth hypothesizes that filament surface perforations measuring 0.35 microns across, 7 microns deep, and separated by walls 0.15 microns thick, may act as waveguides to couple radiation in the visible wavelengths between the tungsten and free space, but inhibit emission of non-visible wavelengths. Waymouth discloses that the perforations on the filament may be formed by semiconductor lithographic techniques, but such perforation dimensions are beyond current state-of-the-art capabilities.

Another method for reducing infrared emissions of an incandescent light source is described in U.S. Pat. No. 5,955,839 issued to Jaffe et al. As described, the presence of microcavities in a filament provides greater control of directivity of emissions and increases emission efficiency in a given bandwidth. Such a light source, for example, may have microcavities between 1 micron and 10 microns in diameter. While features having these dimensions may be formed in some materials using microelectronic processing techniques, it is difficult to form them in metals, such as tungsten, commonly used for incandescent filaments.

Yet another method for reducing infrared emissions of an incandescent light source is disclosed in U.S. Pat. No. 6,433,303 issued to Liu et al. entitled Method and Apparatus Using Laser Pulses to Make an Array of Microcavity Holes. The method disclosed uses a laser beam to form individual microcavities in a metal film. An optical mask divides the laser beam into multiple beams and a lens system focuses the multiple beams onto the metal film and forms the microcavities.

Still another method is disclosed in U.S. Pat. No. 5,389,853 issued, to Bigio et al., and describes a filament having improved emission of visible light. The emissivity of the tungsten filament is improved by depositing a layer of submicron-to-micron crystallites on its surface. The crystallites are formed from tungsten, or a tungsten alloy of up to 1 percent thorium and up to 10 percent of at least one of rhenium, tantalum, and niobium.

While these conventional methods form microcavities and improve light emissivity, they are complex and costly. None of these methods is suitable for mass manufacturing environments where cost and efficiency are important factors. Consequently, a need still exists for a method of making microcavities in a filament that is suitable for mass manufacturing environments.

SUMMARY OF THE INVENTION

A microcavity forming device is provided for making microcavities in a tungsten wire. The microcavity forming device includes a source of particles; a housing for receiving a heated tungsten wire; and a plurality of jet nozzles disposed in the housing for spraying the particles toward the heated tungsten wire with sufficient force to embed the particles into the tungsten wire. The heated tungsten wire is received in the housing and the jet nozzles spray the particles toward the tungsten wire to form the microcavities in the tungsten wire.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Preferred features of embodiments of this invention are now described with reference to the figures. It will be appreciated that the invention is not limited to the embodiments selected for illustration. Also, it should be noted that the drawings are not rendered to any particular scale or proportion. It is contemplated that any of the configurations and materials described hereafter may be modified within the scope of this invention.

Figure 1:
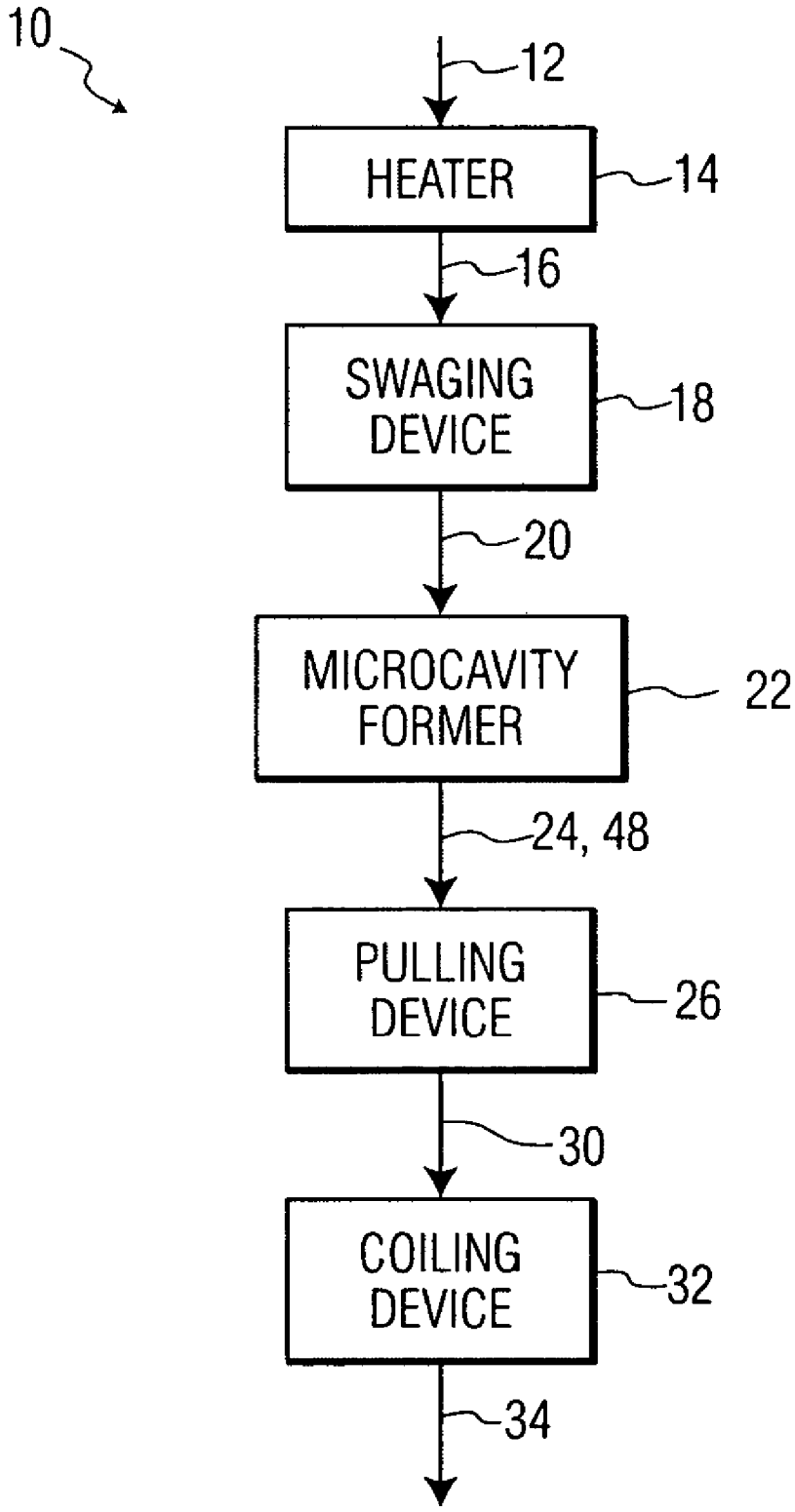
FIG. 1 is a block diagram of a system for making microcavities in a tungsten filament in accordance with the present invention.

Referring to FIG. 1, tungsten filament manufacturing system 10 includes heater 14, swaging device 18, microcavity forming device 22, pulling device 26, and coiling device 32. In operation, tungsten material 12 is heated by heater 14 to form heated tungsten material 16. The tungsten is heated by heater 14 to a malleable temperature (1,200° C. to 1,500° C.). The resulting tungsten material 16 is drawn, utilizing swaging device 18, to reduce the diameter of the tungsten material. The heating and drawing steps are repeated until heated tungsten wire 20 of requisite diameter, typically between 40 microns and 100 microns, is formed. As explained below, microcavity forming device 22 is adapted to form microcavities on the outer surface of heated tungsten wire 20. Microcavitied filament wire 30 is coiled by coiling device 32 to form filament coil 34. The present invention includes several embodiments of microcavity forming device 22, and is discussed in detail below.

Figure 2:
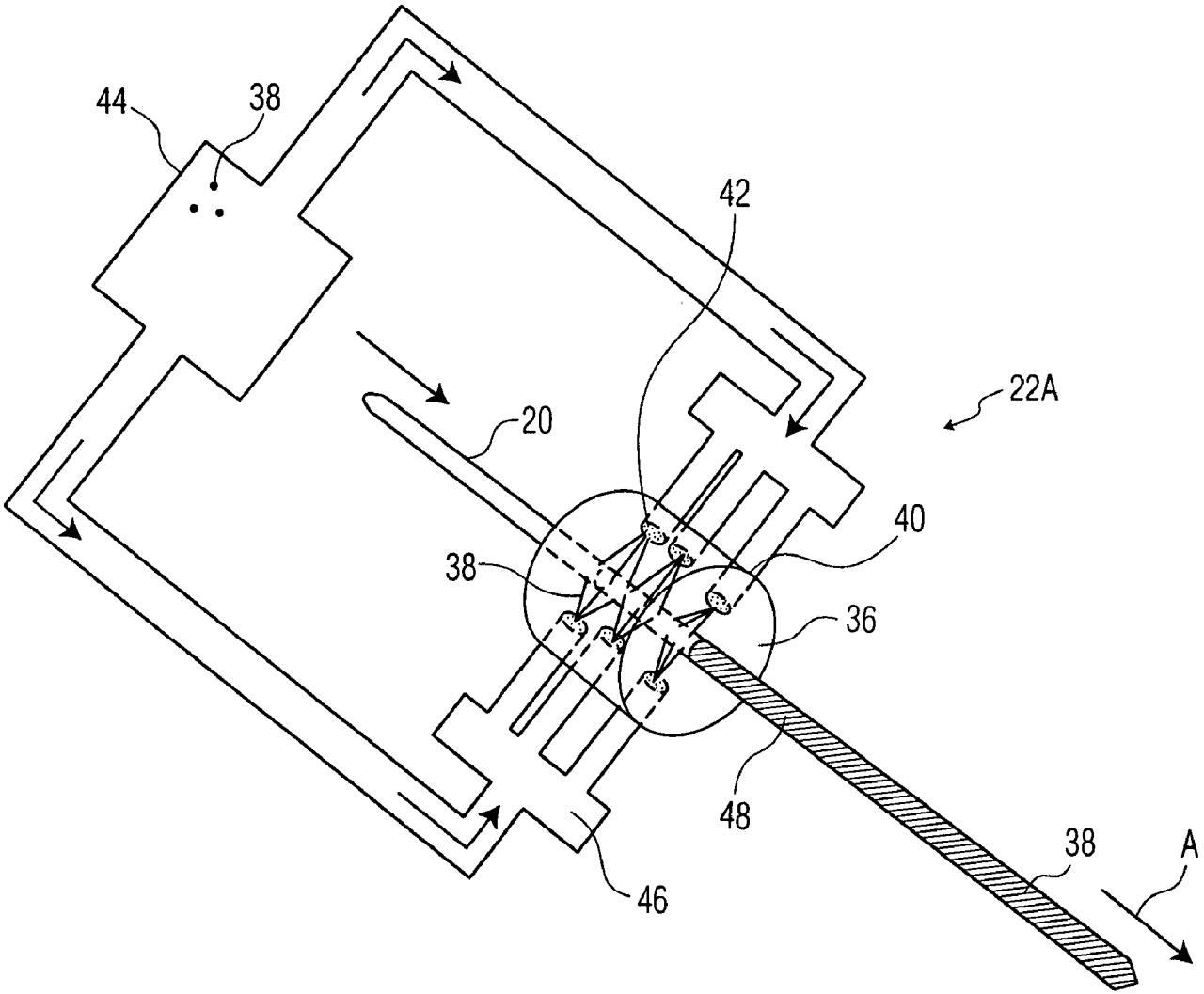
FIG. 2 is a partial perspective view of a microcavity forming device which forms a portion of the system of FIG. 1, including a sprayer in accordance with an embodiment of the present invention.

Referring next to FIG. 2, an embodiment of microcavity forming device 22, generally designated as 22A, is illustrated. Microcavity forming device 22A includes sprayer 36 for depositing particles 38 on heated filament wire 20. Sprayer 36 includes a hollow, circumferential housing 40, which is positioned at a distance from swaging device 18 and is adapted to receive heated tungsten wire 20. Jet nozzles 42, as shown, are mounted at various locations on the inner surface of housing 40, and positioned to spray particles 38 in a radial direction toward tungsten wire 20. Pressurized particle source 44 is adapted to supply particles 38 to distribution bars 46, which in turn, deliver particles 38 to jet nozzles 42. As heated tungsten wire 20 is drawn through circumferential housing 40, jet nozzles 42 spray particles 38 onto tungsten wire 20. Particles 38 are embedded in wire 20 to form tungsten wire having microcavities with particles 38 embedded therein. The tungsten wire with the particles embedded therein is generally designated as 48.

Figure 3A:
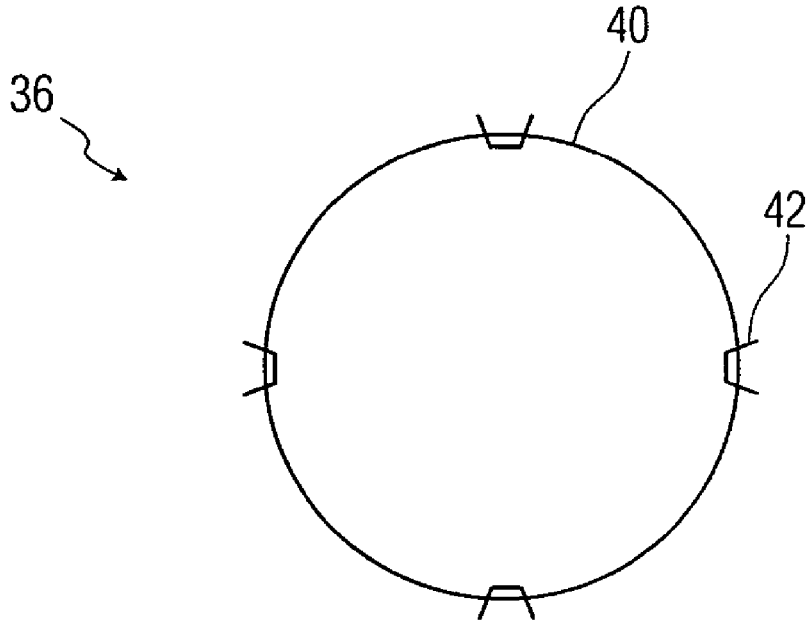
FIG. 3A is a cross-sectional view of the sprayer illustrated in FIG. 2 in accordance with an embodiment of the present invention.
Figure 3B:
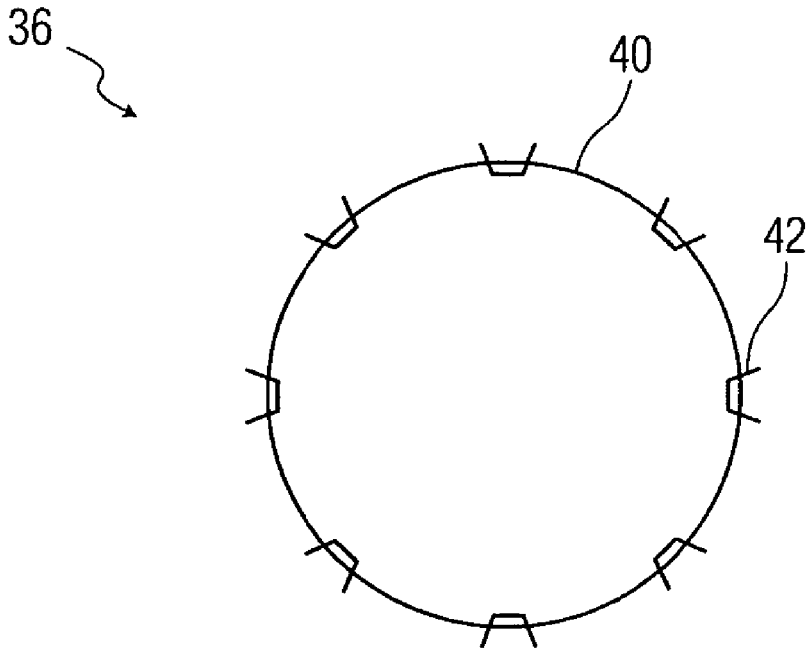
FIG. 3B is a cross-sectional view of the sprayer illustrated in FIG. 2 in accordance with another embodiment of the present invention.

FIGS. 3A and 3B are cross-sectional views of sprayer 36 of FIG. 2. FIG. 3A illustrates a cross-sectional view of four rows of jet nozzles 42 arranged radially 90 degrees apart within housing 40. FIG. 3B illustrates a cross-sectional view of eight rows of jet nozzles 42 arranged radially 45 degrees apart within housing 40. The present invention, however, may have another number of rows of jet nozzles 42 different from that shown in FIGS. 3A and 3B.

Housing 40 may be made from silicon carbide or any other hardened material capable of withstanding the temperature of heated tungsten wire 20 and hardened to prevent damage from the jet sprays. The diameter of particles 38 is preferably 0.35–0.75 micron, and most preferably 0.5 micron. Particles 38 may be made from tantalum, rhenium, molybdenum, tungsten, silicon carbide, rare earth elements, glass beads, or any other hardened material.

In operation referring to FIGS. 1–3, heated tungsten wire 20 exits swaging device 18 and is drawn by pulling device 26 through sprayer 36 of microcavity forming device 22A. High velocity jet nozzles 42 propel particles 38 toward the surface of heated tungsten wire 20 as it moves in direction A through housing 40. Due to malleability from the heating process, as particles 38 contact the surface of heated tungsten wire 20, they form and become embedded in microcavities therein.

As will be appreciated, the diameter of housing 40 and the spacing between jet nozzles 42 in a row may be adjusted based upon a desired density of the embedded particles 38 in the wire. Similarly, the pressure of jet nozzles 42 may be adjusted based upon a desired depth of the microcavity formed by each of the embedded particles 38.

Figure 4:
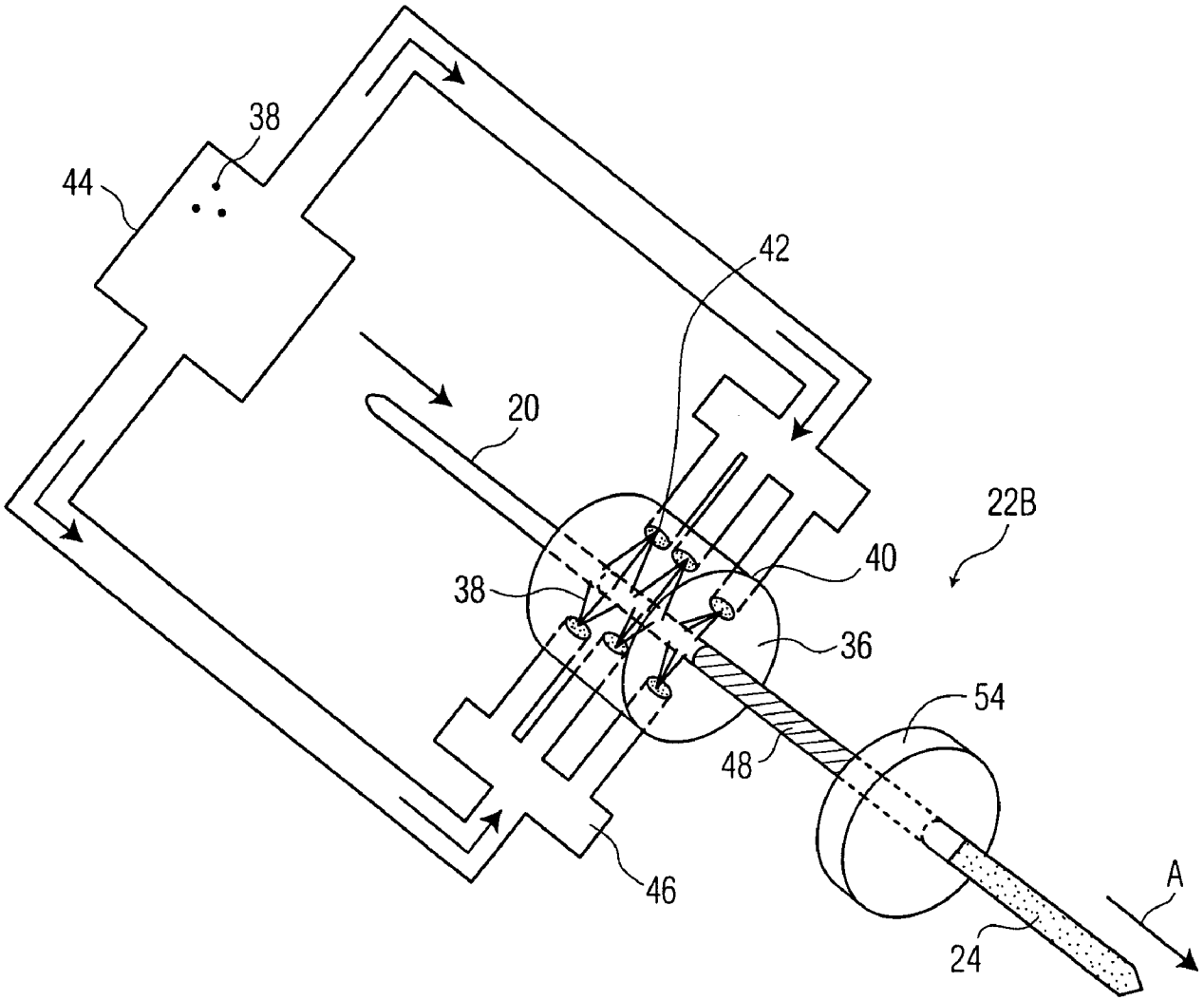
FIG. 4 is a partial perspective view of a microcavity forming device, including a sprayer and a particle remover in accordance with another embodiment of the present invention.

Referring next to FIG. 4, another embodiment, generally designated as 22B, of microcavity forming device 22 is illustrated. Microcavity forming device 22B includes microcavity forming device 22A (illustrated in FIG. 2) and particle remover 54. Cross-sectional views of an exemplary sprayer 36 are illustrated in FIGS. 3A and 3B. Particle remover 54 is disposed downstream of sprayer 36 and removes particles 38 from particled-wire 48 as the wire is drawn from sprayer 36 through particle remover 54. The removal of particles 38 forms microcavitied wire 24.

Figure 5:
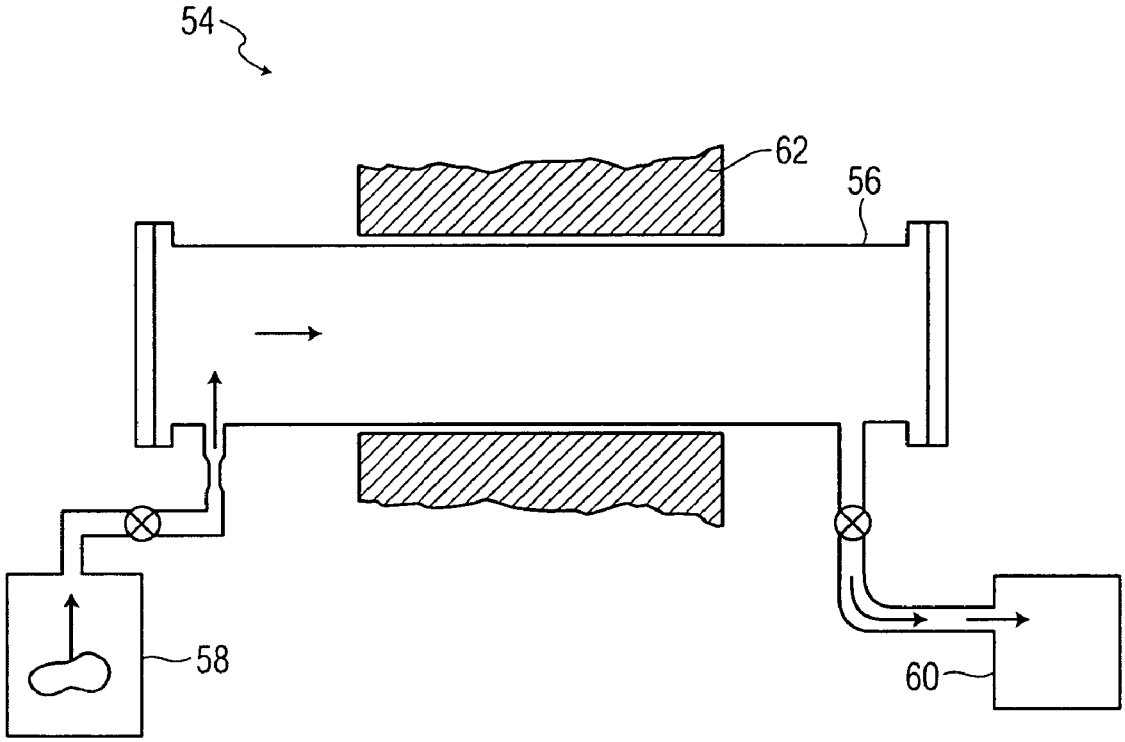
FIG. 5 is a schematic side view of the particle remover illustrated in FIG. 4 in accordance with an embodiment of the present invention.

FIG. 5 is a schematic diagram of particle remover 54 of FIG. 4. The exemplary particle remover 54 includes reactor tube 56, chemical flow control system 58, and vacuum pumping system 60. Reactor tube 56 is surrounded by heater 62.

Particles 38 may be removed from wire 48 in several ways. In one approach, a chemical dissolution process may be used. Chemical solutions suitable for separating particles 38 from wire 48, such as a mixture of nitric acid, sulphuric acid and water, may be placed in chemical flow control system 58, and wire 48 may be placed in reactor tube 56. The wire, which may be wound on a mandrel to form a cassette, may be chemically treated with the chemical solutions to dissolve, or remove the embedded particles. One, or several cassettes may be used.

Vacuum pumping system 60 may be utilized to provide a vacuum in reactor tube 56 and a flow of the chemical solutions through reactor tube 56. Vacuum pumping system 60 may also provide suction to deliver the particles removed from the wire to a reservoir (not shown).

In operation, reactor tube 56 is sealed from the atmosphere, and a chemical solution is added through chemical flow control system 58. Dissolution of particles 38 begins immediately and $NO_x$ gas is formed and mixes with air above the acidic surface. The NO gas combines with $O_2$ in the air and is dissolved. As a result, a low-pressure condition occurs in reactor tube 56. This condition causes a caustic soda solution to be sucked into vacuum pumping system 60. The process acid is removed through vacuum pumping system 60 to a waste reservoir (not shown). The removal of particles 38 results in voids in the outer surface of wire 48, thereby producing microcavitied wire 24.

In an alternate approach, particles 38 may be removed by melting the particles 38. As shown in FIG. 4, microcavity former 22B continues to pass wire 48 in direction A through particle remover 54, heaters 62 may apply heat into reactor tube 56, and melt the particles. This approach is effective if the particles have a lower melting point than the tungsten wire. For example, if the particles are of molybdenum, the particles may be removed by heating since tungsten has a higher melting point than molybdenum.

A further alternate approach for removing particles 38 may be via a blowing process. After cooling, wire 48 may be positioned in a chamber, such as reactor tube 56. Particles 38 may be separated from wire 48 by blowing force of air-flow.

Figure 6:
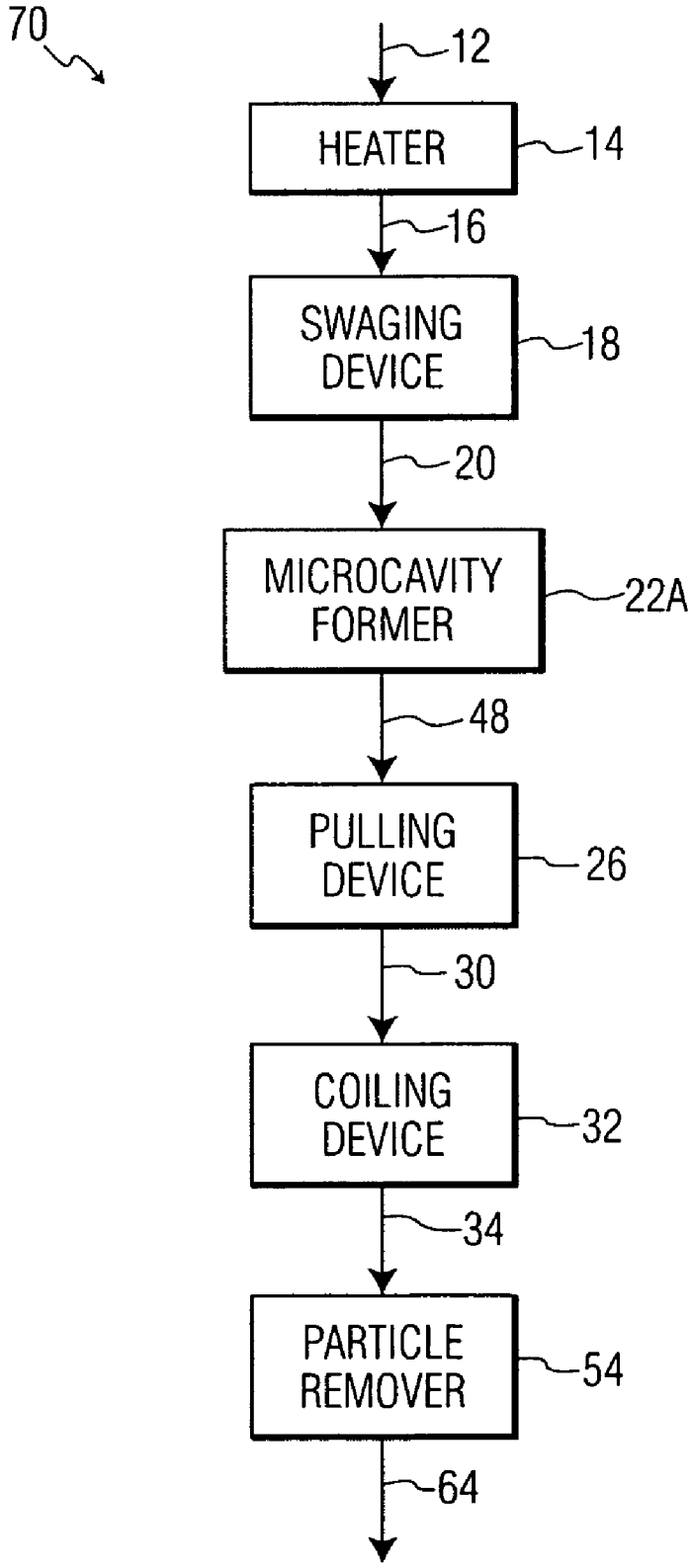
FIG. 6 is a block diagram of a system for making microcavities in a tungsten filament including a particle remover in accordance with the present invention.

Referring next to FIG. 6, another embodiment of tungsten filament manufacturing system 10 is shown and is generally designated as 70. Tungsten filament manufacturing system 70 includes system 10 with microcavity former 22A (FIG. 2) and particle remover 54 positioned downstream after coiling device 32, as shown in FIG. 6. System 70, by way of microcavity former 22A, may form wire 48 having microcavities with particles embedded therein. Wire 48 may then be coiled or wound on a mandrel, as disclosed in U.S. Pat. No. 4,291,444 to McCarty et al. Althouah FIG. 6 shows the particle remover 54 being positioned downstream of the coiling device 32, it is contemplated that it may be positioned upstream of the coiling device 32. In this alternative embodiment, the positions of blocks 54 and 32 would be switched in FIG. 6.

Coiled wire 34 may then be passed through particle remover 54, as previously described, to form coiled microcavitied filament 64.

It will be appreciated that if heated wire 20 is sprayed with molybdenum particles and then coiled or wound on a molybdenum mandrel, as disclosed in U.S. Pat. No. 4,291,444 to McCarty et al., particle remover 54 may use a heating approach to melt both the particles and the mandrel away from the tungsten wire.

The present invention provides an improvement over conventional methods of forming microcavities in a filament, as it is suitable for mass manufacturing environments where cost and efficiency are important factors. The present invention does not require complicated and costly devices, and instead utilizes simple mechanical structures to form microcavities. The present invention may also be implemented with minimum changes to a conventional filament manufacturing production line.

It will be appreciated that other modifications may be made to the illustrated embodiments without departing from the scope of the invention, which is separately defined in the appended claims.

What is claimed:

1. A microcavity forming device for making microcavities in a tungsten wire comprising:
   a source of particles, wherein the particles have a size ranging between 0.35 and 0.75 microns;
   a housing for receiving a heated tungsten wire; and
   a plurality of jet nozzles disposed in the housing for spraying the particles toward the heated tungsten wire with sufficient force to embed the particles into the heated tungsten wire, whereby the particles form the microcavities in the heated tungsten wire.

2. The device of claim 1 wherein the housing includes an enclosed cylindrical surface, and
   the jet nozzles are circumferentially positioned on the enclosed cylindrical surface and directed to spray the particles toward the tungsten wire.

3. The device of claim 2 wherein the heated tungsten wire is received along a length dimension of the cylindrical surface and substantially at a radial center of the housing, and
   the jet nozzles are positioned in a plurality of rows along the length dimension, and each row is circumferentially spaced from another row on the enclosed cylindrical surface.

4. The device of claim 1, further including a particle remover for removing the embedded particles from the tungsten wire.

5. The device of claim 4, in which the particles include molybdenum, and the particle remover includes a heater for heating the particles embedded in the tungsten wire to a melting point temperature of molybdenum,
   whereby the embedded particles are melted away from the tungsten wire.

6. The device of claim 4, wherein the particle remover includes a chemical solution for dissolving the embedded particles in the tungsten wire.

7. The device of claim 4, wherein the particle remover includes a blower for blowing away the embedded particles from the tungsten wire.

8. The device of claim 4 further including
   a coiling device positioned downstream from the particle remover for coiling the tungsten wire, after the particle remover removes the particles from the microcavities in the tungsten wire.

9. The device of claim 4 further including
   a coiling device positioned upstream from the particle remover for coiling the tungsten wire, before the particle remover removes the particles from the microcavities in the tungsten wire.

10. The device of claim 1, wherein the particles are made of one of tantalum, rhenium, molybdenum, tungsten, silicon carbide, rare earth eiements and glass beads, or any combination thereof.

11. The device of claim 1 wherein the housing is formed from a material that includes silicon carbide.

12. The device of claim 1 further including a pulling device for pulling the tungsten wire through the housing, wherein as the pulling device pulls the tungsten wire through the housing, the jet nozzles spray the particles onto the tungsten wire.

13. A method of forming microcavities in a tungsten wire comprising the steps of:

(a) receiving a heated tungsten wire in a housing; and (b) spraying the heated tungsten wire with particles with sufficient force to form microcavities in the tungsten wire, wherein the particles range from 0.35 to 0.75 micron in diameter and are made of one of tantalum, rhenium, molybdenum, tungsten, silicon carbide, rare earth elements and glass beads, or any combination thereof.

14. The method of claim 13 further including the step of:

(c) removing the embedded particles with a particle remover.

15. The method of claim 14 wherein the method further includes the step of:

(d) coiling the tungsten wire after the embedded particles are removed in step (c).

16. The method of claim 14 wherein the method further includes the step of:

(e) coiling the tungsten wire before the embedded particles are removed in step (c).

17. The method of claim 14 wherein step (c) includes heating the heated tungsten wire to melt the embedded particles in the microcavities of the tungsten wire.

18. The method of claim 14 wherein step (c) includes dissolving the embedded particles in the microcavities of the tungsten wire in a chemical solution.

19. The method of claim 13 wherein step (b) includes pulling the tungsten wire while spraying the tungsten wire with particles.

20. The method of claim 13 including heating tungsten material to a malleable temperature, and drawing the tungsten material to form the heated tungsten wire, prior to step (a).

* * * * *